US005321472A

United States Patent [19]

Adachi et al.

[11] Patent Number: 5,321,472

[45] Date of Patent: Jun. 14, 1994

[54] CHARGING MEMBER WITH A BRIDGING ELECTRODE STRUCTURE AND CHARGING DEVICE USING SAME IN AN IMAGE FORMING APPARATUS

[75] Inventors: Hiroyuki Adachi, Tokyo; Norihisa Hoshika, Kawasaki, both of Japan

[73] Assignee: Canon Kabushiki Kaisha, Tokyo, Japan

[21] Appl. No.: 77,493

[22] Filed: Jun. 17, 1993

Related U.S. Application Data

[63] Continuation of Ser. No. 882,251, May 8, 1992, abandoned, which is a continuation of Ser. No. 644,454, Jan. 23, 1991, abandoned.

[30] Foreign Application Priority Data

Jan. 24, 1990 [JP] Japan ..... 2-14095

[51] Int. Cl.[5] ..... G03G 15/02

[52] U.S. Cl. ..... 355/219; 29/825; 29/877; 361/225

[58] Field of Search ..... 355/219, 224, 261; 361/225; 118/647, 649; 29/825, 877

[56] References Cited

U.S. PATENT DOCUMENTS

| | | | |
|---|---|---|---|
| 2,892,973 | 6/1959 | Straughan | 355/219 X |
| 3,146,385 | 12/1960 | Carlson | 361/225 |
| 3,626,260 | 3/1969 | Kimura et al. | 361/225 |
| 4,387,980 | 6/1983 | Ueno et al. | 355/219 |
| 5,006,902 | 4/1991 | Araya | 355/219 X |
| 5,126,913 | 6/1992 | Araya et al. | 355/219 X |

FOREIGN PATENT DOCUMENTS

| | | | |
|---|---|---|---|
| 0308185 | 3/1989 | European Pat. Off. | 355/219 |
| 0312230 | 4/1989 | European Pat. Off. | 355/219 |
| 0217324 | 10/1979 | Japan | 355/219 |
| 56-91253 | 7/1981 | Japan . | |
| 56-104349 | 8/1981 | Japan . | |
| 56-165166 | 12/1981 | Japan . | |
| 59-197071 | 11/1984 | Japan . | |
| 60-147756 | 8/1985 | Japan . | |
| 2282280 | 11/1990 | Japan . | |

*Primary Examiner*—A. T. Grimley
*Assistant Examiner*—Nestor R. Ramirez
*Attorney, Agent, or Firm*—Fitzpatrick, Cella, Scinto & Scinto

[57] ABSTRACT

A charging member for charging a body to be charged includes a blade member, a supporting member which supports the blade member, and an electrode layer which is provided on the blade member and is connected to the supporting member. The electrode layer is formed after connecting the blade member to the supporting member. A charging device uses the charging member. A process unit including the charging device is detachable relative to an image forming apparatus.

42 Claims, 6 Drawing Sheets

CHARGING MEMBER WITH A BRIDGING ELECTRODE STRUCTURE AND CHARGING DEVICE USING SAME IN AN IMAGE FORMING APPARATUS

This application is a continuation of application Ser. No. 07/882,251 filed May 8, 1992, now abandoned, which is a continuation of application Ser. No. 07/644,454 filed Jan. 23, 1991, now abandoned.

BACKGROUND OF THE INVENTION

1. Field of the Invention

This invention relates to a charging member and a charging device for charging a member to be charged, an image forming apparatus, such as an electrophotographic apparatus or the like, having the charging device, and a process unit detachable relative to the apparatus.

2. Description of the Related Art

A corona discharger, such as a corotron, a scorotron or the like, having a wire electrode and a shield electrode surrounding the wire electrode and having an excellent charging uniformness has been widely used as a means for uniformly charging the surface of an image carrying member, such as a photosensitive member, a dielectric member or the like, serving as a member to be charged in an image forming apparatus, such as an electrophotographic copier, an electrophotographic printer, a recording apparatus or the like.

However, the corona discharger has the following problems: An expensive high-voltage power supply is needed. Space is needed for the charger itself, as shield space for the high-voltage power supply, and the like. A large amount of corona products, such as ozone and the like, are produced, and hence additional means and mechanisms are needed in order to deal with the corona products. These factors result in a large and expensive apparatus.

In consideration of the above-described problems, the adoption of a contact charging method has recently been studied as an alternative to the corona discharger.

In contact charging, by contacting a contact charging member, to which a voltage (for example, a DC voltage of about 1-2 kV (kilovolts), or a superposed voltage composed of a DC voltage and an AC voltage) is applied from a power supply, to the surface of an image carrying member, serving as a member to be charged, the surface of the image carrying member is charged at a predetermined potential. Various contact charging methods have been devised, for example, a roller charging method (Japanese Patent Application Public Disclosure (Kokai) No. 56-91253 (1981)), a blade charging method (Japanese Patent Application Public Disclosure (Kokai) Nos. 56-104349 (1981) and 60-147756 (1985)), and a charging-and-cleaning method (Japanese Patent Application Public Disclosure (Kokai) No. 56-165166 (1981)). (U.S. Pat. No. 4,387,980 corresponds to Japanese Patent Document Nos. 56-91253 and 56-104349.)

Among such contact charging methods, the blade charging method is particularly effective for a small image forming apparatus because it provides for an inexpensive and compact apparatus.

One of the problems associated with the contact charging methods including the blade charging method is as follows: If a pinhole portion (a surface defect portion in a member to be charged) is present in an image carrying member, such as a photosensitive member or the like, a spark discharge is apt to occur between a contact charging member, to which a voltage is applied, in contact with the surface of the image carrying member in order to charge the surface of the image carrying member and the pinhole portion in the image carrying member. If such discharge occurs once, a so-called "charge leak" phenomenon will easily subsequently occur on the surface of the image carrying member wherein charged electric charges are not held not only on the pinhole portion but also over the entire surface (the direction of the generatrix of a rotating image carrying member) of the charged region including the pinhole portion in contact with the contact charging member.

For purpose of background information, FIGS. 6(A) and 6(B) illustrate a model for explaining the charge leak phenomenon. In FIG. 6(A), a photosensitive member 1 serves as an image carrying member (a member to be charged) whose surface moves in the direction of the arrow. Pinhole portions P are present in the photosensitive member 1. A blade member 2 (hereinafter termed a "charging blade") of a contact charging member to which a voltage is applied is in contact with the surface of the photosensitive member 1 in order to charge the surface. FIG. 6(B) is an equivalent circuit of FIG. 6(A).

The pinhole portions P in the photosensitive member 1 have lower resistance values than other portions. Hence, when the charging blade 2 contacts the pinhole portions P or the surface of the charging blade 2 comes close to the pinhole portions P, spark discharges S are apt to occur between the charging blade 2 and the pinhole portions P. When the discharges S occur, potentials $V_A$, $V_B$, - - - $V_Z$ at respective portions applied on the surface of the photosensitive member 1 in the direction of the longitudinal direction of the photosensitive member 1 (the direction of the generatrix of the photosensitive member 1) become almost 0 V (volt). As a result, electric charges cannot be held on the surface of the photosensitive member 1 over the entire surface of the contact charging region including the pinhole portions P in contact with charging blade 2.

When the above-described charge leak portions are produced in the charging processing of the surface of the photosensitive member 1, image portions corresponding to the charge leak portions in an output image appear as white stripes in normal development and black stripes in reversal development, causing deterioration in image quality.

The pinholes P are apt to be produced, for example, during the production of an image carrying member (a member to be charged), such as a photosensitive member or the like, due to scratching, or due to dielectric breakdown. It is rather difficult to completely eliminate pinholes.

In order to prevent the above-described charge leaks, it is necessary to increase the electric resistance of the charging blade material. Since the charging blade 2 is pressed with a proper pressure utilizing rubber elasticity, the distance (the free length of the blade) between the distal end of a rigid blade supporting member made, for example, of sheet metal and a portion of the charging blade 2 in contact with the member to be charged must be considerably larger than the thickness of the blade 2. Accordingly, when a voltage is applied from the blade supporting member to the blade 2, the voltage drop in the blade 2 becomes large, causing a decrease in the potential of the portion of the blade 2 in contact with the member to be charged. Hence, it is necessary to attach a back electrode to the charging blade 2, but there has been no excellent means for producing a charging blade having a back electrode.

SUMMARY OF THE INVENTION

The present invention has been made in consideration of the above-described problems.

The invention in one aspect pertains to a charging member for charging a member to be charged, comprising a blade member, a supporting member for supporting the blade member, and an electrode layer primarily provided on the blade member and secondarily on the supporting member to establish an electrical connection therebetween by means of said electrode layer, wherein the electrode layer is formed after connecting the blade member to the supporting member.

The invention in a further aspect pertains to a charging device for charging a member to be charged comprising a blade member for contacting the member to be charged, a supporting member for supporting the blade member, and an electrode layer primarily provided on a surface of the blade member opposite to a surface contacting the member to be charged and secondarily on the supporting member to establish an electrical connection therebetween by means of said electrode layer, wherein the electrode layer is formed after connecting the blade member to the supporting member.

The invention in yet a further aspect pertains to a process unit detachable relative to an image forming apparatus, comprising an image carrying member, and charging means for charging the image carrying member in order to form an image on the image carrying member, the charging means comprising a blade member for contacting the image carrying member, a supporting member for supporting the blade member, and an electrode layer primarily provided on a surface of the blade member opposite to a surface contacting the supporting member and secondarily on the supporting member to establish an electrical connection therebetween by means of said electrode layer, wherein the electrode layer is formed after connecting the blade member to the supporting member.

The invention in still another aspect pertains to an image forming apparatus comprising an image carrying member, an image forming means for forming an image on the image carrying member, and charging means for charging the image carrying member in order to form the image on the image carrying member, the charging means comprising a blade member for contacting the image carrying member, a supporting member for supporting the blade member, and an electrode layer primarily provided on a surface of the blade member opposite to a surface contacting the image carrying member and secondarily on the supporting member to establish an electrical connection therebetween by means of said electrode layer, wherein the electrode layer is formed after connecting the blade member to the supporting member.

The invention in another aspect pertains to a charging member for charging a member to be charged, comprising a blade member, a supporting member for supporting the blade member relative to the member to be charged, and an electrode layer formed primarily on said blade member and secondarily on the supporting member wherein an electrical connection is established between the blade member and the supporting member by the electrode member.

The invention in yet another aspect pertains to a method for making a charging member comprising the steps of providing a blade member, providing a supporting member, connecting the blade member to the supporting member, and forming an electrode layer primarily on the blade member and secondarily on the supporting member after the blade member and the supporting member have been connected to establish an electrical connection therebetween by means of the electrode layer.

These and other objects and features of the present invention will become more apparent from the following detailed description taken in connection with the accompanying drawings.

DETAILED DESCRIPTION OF THE PREFERRED EMBODIMENTS

Preferred embodiments of the present invention will now be explained with reference to the drawings.

Figure 2:
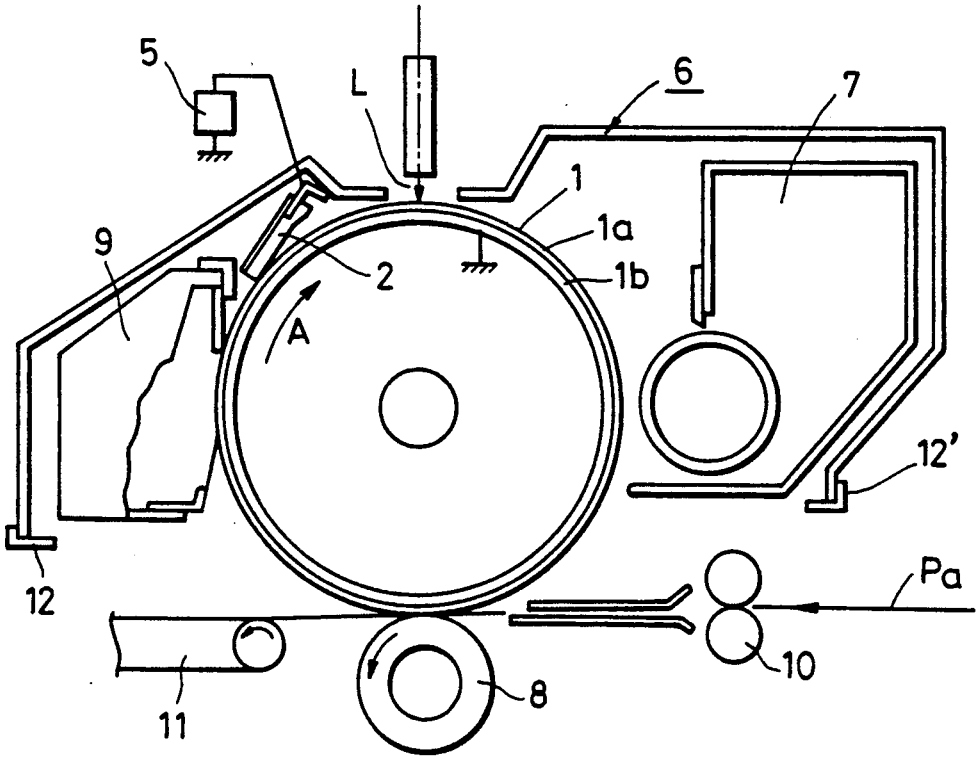
FIG. 2 is a schematic diagram of an image forming apparatus incorporating a contact charging device using a charging blade.

FIG. 2 is a schematic diagram of the configuration of a principal part of an image forming apparatus which incorporates a contact charging device using a contact charging member according to the present invention as the charging processing means for an image carrying member.

In FIG. 2, a rotating-drum-type electrophotographic photosensitive member (termed hereinafter a "photosensitive drum") serves as an image carrying member.

The photosensitive drum 1 is composed of an organic photoconductive layer 1*a* which is a surface layer, and a grounded conductive substrate 1*b* made, for example, of aluminum for supporting the organic photoconductive layer 1*a*.

The photosensitive drum 1 is rotatably driven in the clockwise direction as shown by arrow A at a predetermined circumferential speed (process speed).

The photosensitive drum 1 is uniformly charged at a predetermined polarity and a predetermined potential during its rotation by a charging blade 2 serving as a contact charging member of a contact charging device (to be described later).

Subsequently, the charged surface of the photosensitive drum 1 is subjected to exposure L (for example, exposure by an analog optical system for imaging and exposing the image of an original, scanning exposure by a digital optical system including a laser-beam scanner, an LED array or the like) in accordance with object image information at an exposing portion. Thus, an electrostatic latent image corresponding to the object image information is formed.

The formed latent image is then subjected to normal or reversal development using toner by a developing unit 7.

On the other hand, a transfer material Pa is fed from a paper feed mechanism (not shown), and is supplied to a space (transfer portion) between the photosensitive drum 1 and a transfer roller 8 (for example, a corona charger may also be used), serving as transfer means, with a predetermined timing by registration rollers 10. The developed image formed on the photosensitive drum 1 is sequentially transferred to the fed transfer material Pa.

The transfer material Pa passing through the transfer portion is separated from the surface of the photosensitive drum 1, and is guided into a fixing unit (not shown) by feed means 11. The image on the transfer material Pa is fixed in the fixing unit.

Unnecessary particles remaining on the surface of the photosensitive drum 1 after image transfer are removed by a cleaning unit 9, and the photosensitive drum 1 is repeatedly used for forming images.

The image forming apparatus of the present embodiment is constituted as a process unit 6 wherein the four process devices, that is, the photosensitive drum 1, the charging blade 2, the developing unit 7 and the cleaning unit 9, are incorporated as a unit with a predetermined mutual positional relationship. The unit 6 can be mounted by inserting it into the main body of the image forming apparatus along supporting rails 12, 12' in the direction perpendicular to the plane of FIG. 2. The unit 6 is also detachable from the main body of the image forming apparatus. The process unit 6 may comprise the photosensitive drum 1 and the charging blade 2.

By sufficiently inserting the process unit 6 within the main body of the image forming apparatus, the main body of the apparatus and the unit 6 are mechanically and electrically coupled with each other, and the image forming apparatus assumes an operable state.

Figure 1:
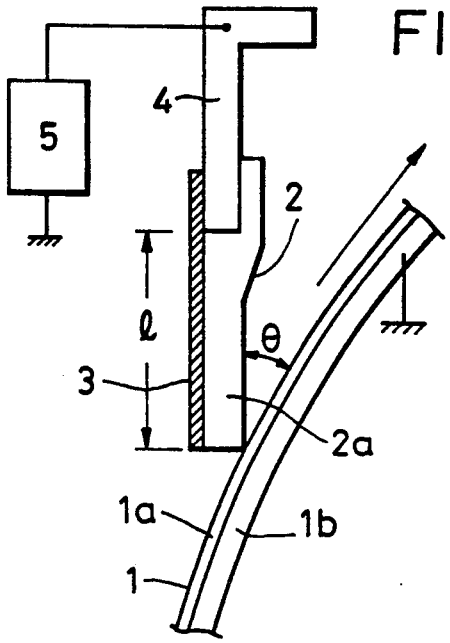
FIG. 1 is a schematic diagram of a charging blade portion of a contact charging device.

FIG. 1 is a model diagram of the contact charging device portion of the image forming apparatus shown in FIG. 2.

The substrate of the charging blade 2 is, for example, an elastic rubber blade 2*a* 1–2 mm thick made of hydrin, EPDM (ethylene/propylene/diene terpolymer), urethane or the like whose volume resistivity is controlled to about $10^7$–$10^9\Omega$·cm. The base portion of the charging blade 2 is mounted on a conductive rigid supporting member 4, made of a steel plate or the like, as a unit using an adhesive or the like. Alternatively, the charging blade 2 and the supporting member 4 are molded and held as a unit by injecting the blade material into a metal mold. By setting the free length l (the distance between the distal end of the blade supporting member and the portion of the blade 2 in contact with the photosensitive drum 1) of the blade 2 to about 5–15 mm, the contact angle $\theta$ (the angle made by the distal end of the blade 2 and the downstream tangent line from the contact point of the blade 2 with the drum 1 in the direction of the movement of the surface of the drum 1 at the contact point) relative to the photosensitive drum 1 to about 8°–25°, and the contact pressure to about 4–40 gr/cm, the distal end of the blade 2 contacts the drum 1 in the counter direction (the contact angle is an acute angle) relative to the rotation of the photosensitive drum 1. The contact of the charging blade 2 with the photosensitive drum 1 may also be in the forward direction (the contact angle is an obtuse angle) relative to the rotation of the drum 1.

On a surface (i.e., the back of the blade 2) opposite to a surface in contact with the photosensitive drum 1 is formed a back electrode 3 by printing with a conductive paint. The back electrode 3 bridges the conductive rigid supporting member 4 and the supporting blade 2 such that the two are electrically connected. As described above, the contact charging member includes the charging blade 2 having the rubber blade 2*a* and the electrode layer 3, and the supporting member 4.

A power supply 5 for applying a voltage to the charging blade 2 applies to the conductive rigid supporting member 4 of the charging blade 2, for example, a DC voltage corresponding to a potential necessary for the photosensitive drum 1, or a bias voltage obtained by superposing an alternating voltage having a peak-to-peak voltage at least twice the discharge starting voltage ($V_{TH}$) determined from the charging blade 2 and the photosensitive drum 1 with the DC voltage in order to obtain uniform charging.

The above-described superposed bias voltage is a voltage whose value periodically changes. It may, for example, be a sinusoidal-wave AC voltage, or a rectangular-wave AC voltage which is formed by periodically switching on and off a DC power supply.

As described above, by applying a bias voltage to the conductive rigid supporting member 4, a voltage is applied to the charging blade 2 via the supporting member 4 and the back electrode 3 electrically connected thereto. As a result, an electric field is produced at the contact portion between the charging blade 2 and the photosensitive drum 1, and the surface of the photosensitive drum 1 is thereby uniformly charged at a predetermined polarity and a predetermined potential.

Figure 3:
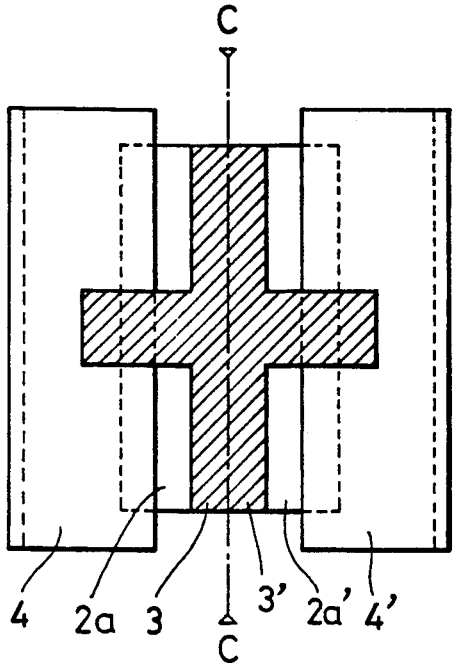
FIG. 3(A) is a diagram illustrating how charging blades are formed.
FIG. 3(B) is an enlarged view of a cut distal-end portion of a charging blade.
FIG. 3(C) is a diagram showing a state wherein a coated electrode-layer material has moved on a side end of the cut distal-end portion of the blade.
FIG. 3(D) is a perspective view of the embodiment shown in FIG. 3(A).

In FIG. 3(A), a rubber blade 2*a*, serving as the substrates of charging blade 2, is sized to provide two sheets of charging blades having a predetermined size. If the rubber blade 2*a* is cut along its longitudinal central axis C—C, two substrates of charging blades having the predetermined size are obtained. FIG. 3(D) shows a perspective view of the embodiment shown in FIG. 3(A).

Conductive rigid supporting members 4, 4' are connected to the left and right side portions of the rubber blade 2*a* having the size for two sheets as one body symmetrically relative to the axis C—C using an adhesive or the like. Subsequently, a back electrode layer 3 having a volume resistivity of $10^2$–$10^3$ Ω·cm and having a cross-like patterned region, as shown by hatching, is formed symmetrically relative to the longitudinal central axis C—C by printing with a conductive paint made, for example, of polyurethane and the like on the back of the rubber blade 2*a* having the size of two sheets. Any material having a volume resistivity of $10^5$ Ω·cm or less may be used for the electrode layer 3. In this case, the supporting members 4, 4' and the electrode layer 3 are electrically connected by forming part of the back electrode layer 3 so as to extend on respective surfaces of the previously connected supporting members 4, 4'. After the above-described printing process, two charging blades are obtained by cutting the rubber blade 2a having the size for two sheets along the longitudinal central axis C—C.

As described above, by forming the electrode layer 3 over the supporting members 4, 4' from the back of the blade 2a after connecting the rubber blade 2a to the supporting members 4, 4', the supporting members 4, 4' and the blade 2a can be electrically connected at the same time as the electrode layer 3 is provided. Hence, the production process of the charging member is simplified. If the charging member is formed by connecting the electrode layer and the supporting member so as to superpose with each other after forming the electrode layer on the rubber blade, and the photosensitive drum is rotatably moved while contacting the charging blade to the photosensitive drum, the connected portion may easily peel according to a state wherein the electrode layer is formed, or the positional accuracy of the blade or the electrode layer relative to the drum may decrease. Moreover, if an adhesive is used for connecting the electrode layer and the supporting member by superposing them, the adhesive must be conductive. Hence, the usable range of adhesives is limited. Accordingly, by forming the electrode layer 3 over the blade 2a and the supporting members 4, 4' after connecting the blade 2a to the supporting members 4, 4', as described above, the connecting force between the blade and the supporting member can be stabilized for a long period, and the positional accuracy of the blade relative to the drum increases. As a result, it is possible to perform stable charging. In addition, the usable range of adhesives is increased.

By cutting the blade after forming the electrode layer as described above, an excellent finish accuracy for the blade's cut surface $C_1$ can be obtained, and the blade can be provided without having an electrode-layer material deposited on the portion of the blade in contact with the member to be charged.

The back electrode layer 3 need not be formed on the entire surface of the back of the blade 2a, but it is sufficient if there are a back portion of the blade 2a corresponding to the distal-end portion of the blade 2a in contact with the member 1 to be charged, and a connecting portion for electrically connecting that portion to the supporting member 4, serving as the voltage supply side, as the T-like pattern (the pattern after cutting along the axis C—C) in the present embodiment.

Figures 3B, 3C:
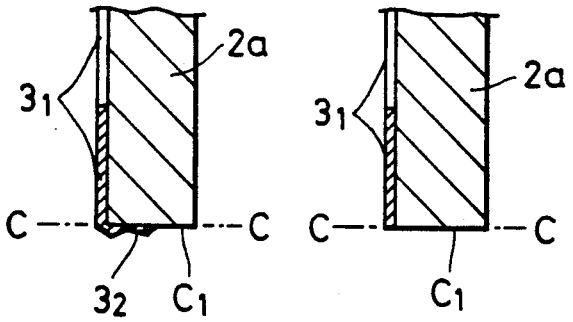
Figure 3D:
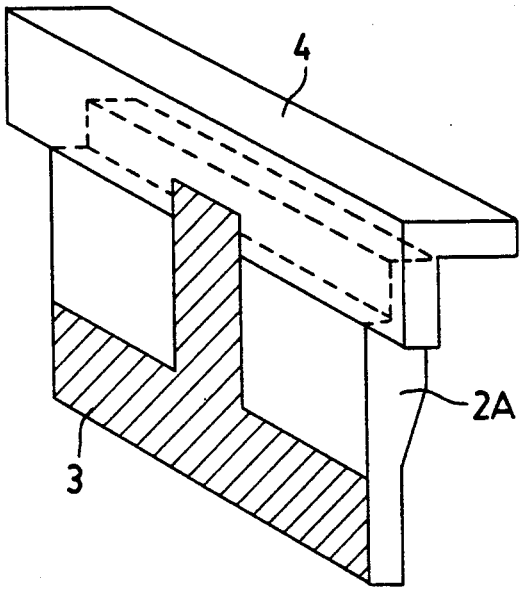

If an electrode layer $3_1$ is formed by coating an electrode-layer material on the back of the rubber blade 2a after the connection/cutting, as shown in FIG. 3(B), electric charge leaks may occur in some cases, for example, due to the movement of the coated electrode-layer material in the neighborhood of the contact portion, as shown by reference numeral $3_2$ in FIG. 3(C).

Figure 4:
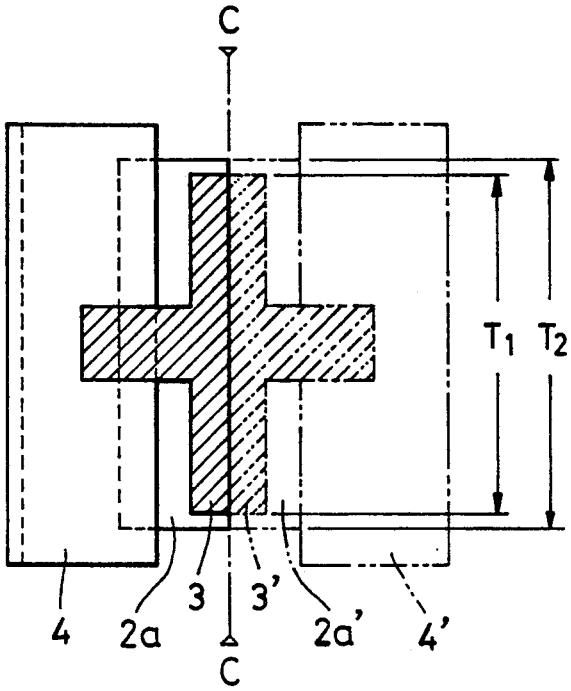
FIG. 4(A) is a diagram illustrating another example of the configuration of a charging blade.
FIG. 4(B) is a diagram showing a state wherein an electrode-layer material has moved on a side-end portion of the blade.
Figure 4:
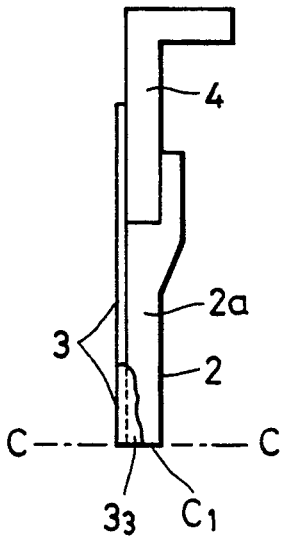

In the case of FIG. 3(B), even if the electrode layer 3 is formed on the back of the blade 2a with highly accurate printing, a case may arise wherein the electrode-layer material moves on one or both of the right and left end portions, as shown by reference numeral $3_3$ in FIG. 4(B). The presence of such moved electrode-layer material $3_3$ may cause other types of electric charge leaks.

In order to prevent such a problem, it is effective to previously form the pattern of the electrode layer 3 so that the relationship of the width $T_2$ of the charging blade > the width $T_1$ of the electrode layer holds in the direction of the generatrix (the longitudinal direction) of the photosensitive drum 1, as shown in FIG. 4(A).

Figure 5A:
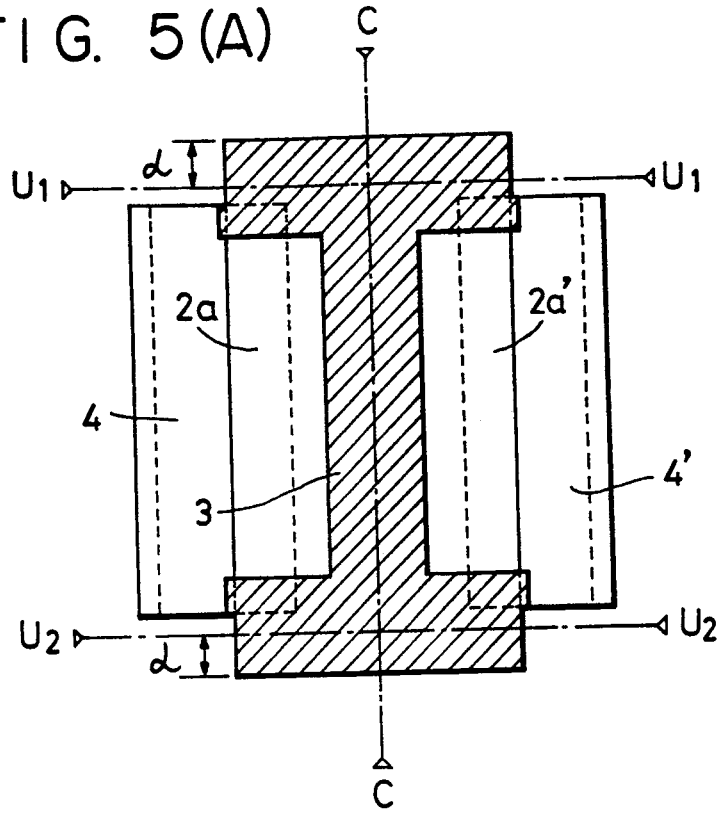
FIGS. 5(A) and 5(B) ilustrate still another example of the configuration of a charging blade.

Alternatively, as shown in FIG. 5(A), the width of the blade 2a may be increased by $\alpha$ and $\alpha$ at its right and left end sides, respectively, the supporting members 4, 4' may be attached to the blade 2a, and the electrode layer 3 may then be formed. Subsequently, the blade 2a may be cut along its central axis C—C, and the extra widths $\alpha$ and $\alpha$ at the right and left end sides may be removed by cutting along lines $U_1$–$U_1$ and $U_2$–$U_2$. Thus, an excellent finish accuracy for the right and left end sides of the blade 2a can be obtained, as shown in FIG. 5(B), and it is possible to eliminate the trouble of electric charge leaks due to the movement of the electrode-layer material onto the right and left end sides.

Figure 5B:
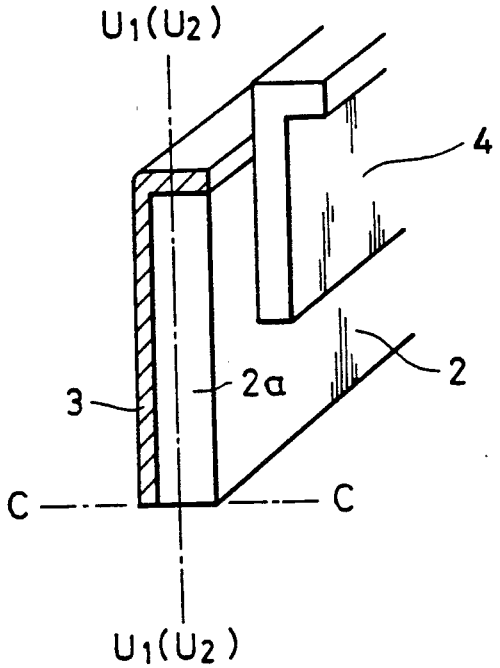
Figure 6:
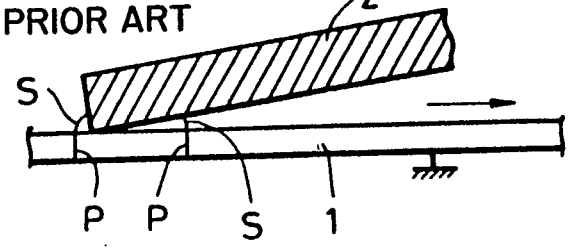
FIG. 6 (A) PRIOR ART
FIG. 6(A) is a model diagram for explaining a charge leak phenomenon.
FIG. 6(B) is an equivalent circuit of FIG. 6(A).
Figure 6:
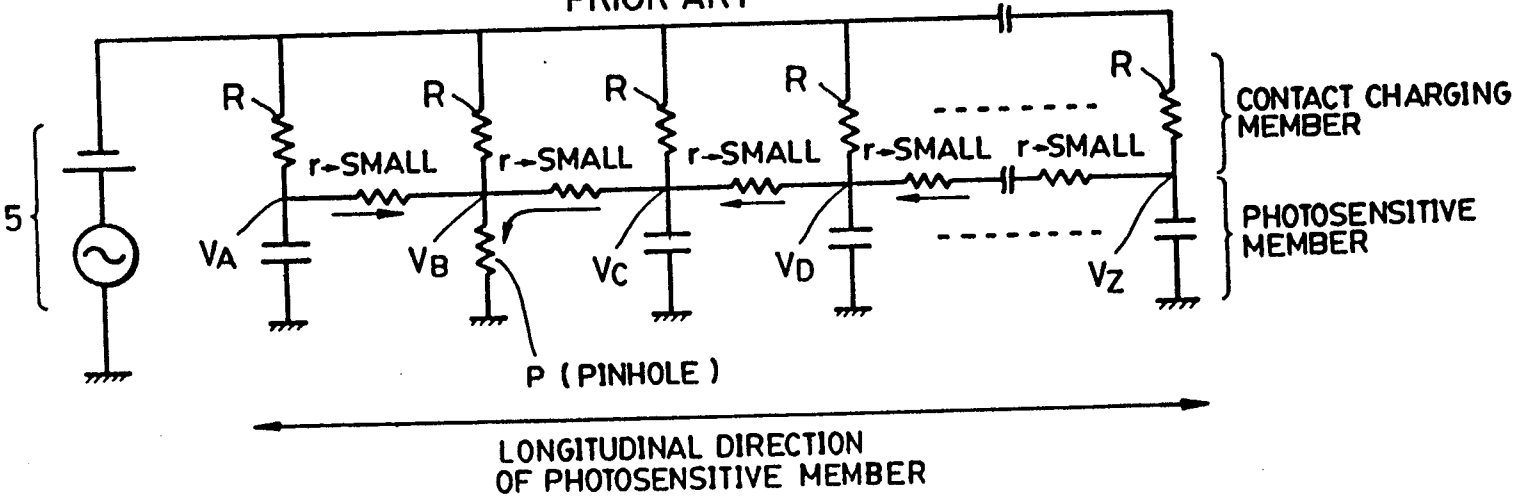
FIG. 6 (B) PRIOR ART

The pattern of the electrode layer 3 in the embodiment shown in FIGS. 5(A) and 5(B) is C shaped and is composed of a portion along the distal-end side of the blade 2a and portions along the right and left end sides of the blade 2a on the back of the blade 2a.

The electrode layer 3 may be coated on the entire surface of the back of the blade 2a. For example, the electrode layer 3 may be first formed on the entire surface of the back of the blade 2a using spray coating followed by the above-described cutting process. In the case of providing two sheets, the blade 2a may be cut along its center line C—C.

Although an explanation has been provided of a rubber blade, the charging blade may also be composed of a sheet material or a film material. The back electrode layer 3 may be formed and configured in the same manner as explained above.

As explained above, the present invention has the following effects: By forming an electrode layer on a charging blade, serving as a contact charging member, after connecting the blade to its supporting member as one body, it is possible to stabilize the connecting force between the two members for a long period, to accurately contact the blade to a member to be charged and thereby perform stable charging, and to simplify the production process of the charging member.

While the present invention has been described with respect to what is presently considered to be the preferred embodiment, it is to be understood that the invention is not limited to the disclosed embodiment. To the contrary, the invention is intended to cover various modifications and equivalent arrangement included within the spirit and scope of the appended claims. The scope of the following claims is to be accorded the broadest interpretation so as to encompass all such modifications and equivalent structures and functions.

What is claimed is:

1. A charging member for charging a body to be charged, comprising:

a blade member having a contacting end for contacting the body to be charged;

a supporting member for supporting said blade member; and an electrode layer provided primarily on said blade member and secondarily on a surface of said supporting member to establish an electrical connection therebetween by means of said electrode layer, wherein an end of said electrode layer nearest the contacting end of said blade member is substantially coterminous with the contacting end of said blade member.

2. A charging member according to claim 1, wherein the body to be charged is rotatable and the width of said blade member is larger than the width of said electrode layer in the direction of the generatrix of the rotatable body to be charged.

3. A charging member according to claim 1, wherein said blade member comprises an elastic material.

4. A charging member according to claim 1, wherein said charging member contacts the body to be charged.

5. A charging member according to claim 1, wherein said supporting member comprises a conductive material.

6. A charging member according to claim 5, wherein said supporting member is rigid.

7. A charging device according to claim 1, wherein said electrode layer extends to the vicinity of a free end of said blade member proximate said body to be charged.

8. A charging device for charging a body to be charged, comprising:

a blade member for contacting the body to be charged;

a supporting member for supporting said blade member; and an electrode layer primarily provided on a surface of said blade member opposite to a surface that contains a contacting portion of said blade member in contact with the body to be charged and secondarily on said supporting member to establish an electrical connection therebetween by means of said electrode layer, said electrode layer extending in the vicinity of said contacting portion.

9. A charging device according to claim 8, wherein the body to be charged is rotatable and the width of said blade member is larger than the width of said electrode layer in the direction of the generatrix of the rotatable body to be charged.

10. A charging device according to claim 8, wherein said blade member is formed from an elastic material.

11. A charging device according to claim 8, wherein said supporting member is formed from a conductive material.

12. A charging device according to claim 11, wherein said device comprises means for applying voltage to said supporting member in order to perform the charging.

13. A charging device according to claim 8, wherein said supporting member is rigid.

14. A charging device according to claim 8, wherein said electrode layer is formed after connecting the blade member to the supporting member.

15. A process unit detachable relative to an image forming apparatus, comprising:

an image carrying member; and charging means for charging said image carrying member in order to form an image on said image carrying member, said charging means comprising a blade member for contacting said image carrying member, a supporting member for supporting said blade member, and an electrode layer primarily provided on a surface of said blade member opposite to a surface that contains a contacting portion of said blade member in contact with said image carrying member and secondarily on said supporting member to establish an electrical connection therebetween by means of said electrode layer, and said electrode layer extending in the vicinity of said contacting portion.

16. A process unit according to claim 15, further comprising developing means for developing a latent image on said image carrying member using a charge provided by said charging means.

17. A process unit according to claim 15, wherein the image carrying member is rotatable and the width of said blade member is larger than the width of said electrode layer in the direction of the generatrix of the rotatable image carrying member.

18. A process unit according to claim 15, wherein said blade member is formed from an elastic material.

19. A process unit according to claim 15, wherein said supporting member is formed from a conductive material.

20. A process unit according to claim 19, wherein voltage is applied to said supporting member in order to perform charging.

21. A process unit according to claim 15, wherein said supporting member is rigid.

22. A process unit according to claim 15, wherein said electrode layer is formed after connecting the blade member to the supporting member.

23. An image forming apparatus comprising:

an image carrying member;

an image forming means for forming an image on said image carrying member; and charging means for charging said image carrying member in order to form the image on said image carrying member, said charging means comprising a blade member for contacting said image carrying member, a supporting member for supporting said blade member, and an electrode layer primarily provided on a surface of said blade member opposite to a surface that contains a contacting portion of said blade member in contact with said image carrying member and secondarily on said supporting member to establish an electrical connection therebetween by means of said electrode layer, and said electrode layer extending in the vicinity of said contacting portion.

24. An image forming apparatus according to claim 23, wherein the image carrying member is rotatable and the width of said blade member is larger than the width of said electrode layer in the direction of the generatrix of the rotatable image carrying member.

25. An image forming apparatus according to claim 23, wherein said blade member is formed from an elastic material.

26. An image forming apparatus according to claim 23, wherein said supporting member is formed from a conductive material.

27. An image forming apparatus according to claim 26, further comprising means for applying voltage to said supporting member in order to perform the charging.

28. An image forming apparatus according to claim 23, wherein said supporting member is rigid.

29. An image forming apparatus according to claim 23, wherein said electrode layer is formed after connecting the blade member to the supporting member.

30. A method for making a charging member comprising the steps of:

providing a blade member;

providing a supporting member;

connecting said blade member to said supporting member; and forming an electrode layer primarily on said blade member and secondarily on said supporting member after said blade member and said supporting member have been connected to establish an electrical connection therebetween by means of said electrode layer.

31. The method of claim 30, further comprising the step of sizing the blade member such that the width of said blade member is larger than the width of said electrode layer in the direction of a generatrix of a member to be charged by the charging member.

32. The method of claim 30, further comprising the step of fabricating said blade member from an elastic material.

33. The method of claim 30, further comprising the step of fabricating said supporting member to be rigid.

34. A charging device for charging a body to be charged, comprising:

a blade member having a contacting end for contacting the body to be charged;

a supporting member for supporting said blade member; and an electrode layer provided on said blade member and on a surface of said supporting member to establish an electrode connection therebetween by means of said electrode layer, wherein an end of said electrode layer nearest the contacting end of said blade member is substantially coterminous with the contacting end of said blade member.

35. A charging device according to claim 34, wherein said electrode layer lies on a surface opposite to a surface that contains a contacting portion of said blade member in contact with the body to be charged, where said electrode layer extends in the vicinity of said contacting portion.

36. A charging device according to claim 34, wherein said electrode layer is formed after connecting the blade member to the supporting member.

37. A charging device for charging a body to be charged, comprising:

a blade member having a contacting end for contacting the body to be charged;

a supporting member for supporting said blade member; and an electrode layer primarily provided on a surface of said blade member opposite to a surface contacting the body to be charged and secondarily on a surface of said supporting member to establish an electrical connection therebetween by means of said electrode layer, wherein an end of said electrode layer nearest the contacting end of said blade member is substantially coterminous with the contacting end of said blade member.

38. A process unit detachable relative to an image forming apparatus, comprising:

an image carrying member; and charging means for charging said image carrying member in order to form an image on said image carrying member, said charging means comprising a blade member having a contacting end for contacting said image carrying member, a supporting member for supporting said blade member, and an electrode layer primarily provided on a surface of said blade member opposite to a surface contacting said image carrying member and secondarily on a surface of said supporting member to establish an electrical connection therebetween by means of said electrode layer, wherein an end of said electrode layer nearest the contacting end of said blade member is substantially coterminous with the contacting end of said blade member.

39. An image forming apparatus comprising:

an image carrying member;

image forming means for forming an image on said image carrying member; and charging means for charging said image carrying member in order to form the image on said image carrying member, said charging means comprising a blade member having a contacting end for contacting said image carrying member, a supporting member for supporting said blade member, and an electrode layer primarily provided on a surface of said blade member opposite to a surface contacting said image carrying member and secondarily on a surface of said supporting member to establish an electrical connection therebetween by means of said electrode layer, wherein an end of said electrode layer nearest the contacting end of said blade member is substantially coterminous with the contacting end of said blade member.

40. A charging device for charging a body to be charged, comprising:

a blade member for contacting the body to be charged;

a supporting member contacting said blade member for supporting said blade member; and an electrode layer primarily provided on a surface of said blade member opposite to a surface contacting the body to be charged and secondarily on said supporting member to establish an electrical connection therebetween by means of said electrode layer, said electrode layer extending in the vicinity of a contacting portion of said blade member which contacts the body to be charged.

41. A process unit detachable relative to an image forming apparatus, comprising:

an image carrying member; and charging means for charging said image carrying member in order to form an image on said image carrying member, said charging means comprising a blade member for contacting said image carrying member, a supporting member contacting said blade member for supporting said blade member, and an electrode layer primarily provided on a surface of said blade member opposite to a surface contacting said image carrying member and secondarily on said supporting member to establish an electrical connection therebetween by means of said electrode layer, and said electrode layer extending in the vicinity of a contacting portion of said blade member which contacts the image carrying member.

42. An image forming apparatus comprising:

an image carrying member;

an image forming means for forming an image on said image carrying member; and charging means for charging said image carrying member in order to form the image on said image carrying member, said charging means comprising a blade member for contacting said image carrying member, a supporting member contacting said blade member for supporting said blade member, and an electrode layer primarily provided on a surface of said blade member opposite to a surface contacting said image carrying member and secondarily on said supporting member to establish an electrical connection therebetween by means of said electrode layer, and said electrode layer extending in the vicinity of a contacting portion of said blade member which contacts the image carrying member.

* * * * *

UNITED STATES PATENT AND TRADEMARK OFFICE

CERTIFICATE OF CORRECTION

PATENT NO. : 5,321,472

DATED : June 14, 1994

INVENTOR(S) : Adachi et al.

It is certified that error appears in the above-indentified patent and that said Letters Patent is hereby corrected as shown below: Title page, At [56] FOREIGN PATENT DOCUMENTS

| | | |
|---|---|---|
| "0217324 | 10/1979 | Japan" should read |
| --0127324 | 10/1979 | Japan--. |
| "2282280 | 11/1990 | Japan" should read |
| --2-282280 | 11/1990 | Japan--. |

Insert: --0439143 7/1991 European Pat. Off.--;

Column 4

Line 28, "blade; Fig. 3(D)" should read --blade; ¶ FIG. 3(D)--.

Signed and Sealed this

Twenty-eight Day of March, 1995

Bruce Lehman

*Attest:*

BRUCE LEHMAN

*Attesting Officer*

*Commissioner of Patents and Trademarks*